United States Patent [19]

Bassa

[11] Patent Number: 4,760,946

[45] Date of Patent: Aug. 2, 1988

[54] DEVICE FOR TURNING A MOVING WEB

[75] Inventor: Altan Bassa, Dreieich, Fed. Rep. of Germany

[73] Assignee: E. I. Du Pont de Nemours and Company, Wilmington, Del.

[21] Appl. No.: 842,583

[22] Filed: Mar. 21, 1986

[30] Foreign Application Priority Data

Apr. 4, 1985 [DE] Fed. Rep. of Germany ..... 3512316

[51] Int. Cl.[4] ..... B65H 20/00

[52] U.S. Cl. ..... 226/97; 226/182

[58] Field of Search ..... 34/122, 123; 226/97, 226/168, 118, 181, 182, 183, 189, 196; 242/76; 354/299, 300

[56] References Cited

U.S. PATENT DOCUMENTS

| | | | |
|---|---|---|---|
| 3,087,664 | 4/1963 | Streeter | 226/97 |
| 3,587,598 | 6/1971 | Miyamatsu | 226/97 X |
| 3,638,845 | 2/1972 | Herzhoff et al. | 226/97 |
| 3,767,097 | 10/1973 | Watts et al. | 226/97 X |
| 3,779,481 | 12/1973 | Wilson | 226/97 X |
| 4,059,241 | 11/1977 | De Roeck et al. | 226/97 X |
| 4,305,536 | 12/1981 | Burdorf et al. | 226/196 X |

*Primary Examiner*—Daniel P. Stodola

[57] ABSTRACT

In a device for the guiding of a moving web (1) that has on its inner side a contact-sensitive surface (3), the web (1) separates two zones (13, 14) in the guide region from one another. The outer zone (14) is formed by a housing (7) connected with a reduced pressure source (P). The inner zone (13) is connected with the atmosphere. To seal the housing (7) against the atmosphere, sealing elements (16, 17) extending across the width of the web at the beginning and end zones of the guide region interact with the outer side of the web (1). As a result of the pressure difference, a gap is formed between the guide surfaces (8, 9) of a support (6) and the web, so that the contact-sensitive surface is not supported in the guide region.

7 Claims, 2 Drawing Sheets

DEVICE FOR TURNING A MOVING WEB

BACKGROUND

This invention relates generally to the transport of webs and, more particularly to the guidance of a freshly coated web through a change in the direction of its advance.

It is known in the art that webs can be turned around a so-called air bar. For example, in U.S. Pat. No. 4,059,241 to DeRoeck et al., an advancing film separates inner and outer zones, the outer zone being under atmospheric pressure, while the inner zone is provided with compressed air. A dividing gap through which air flows from inside to outside is formed automatically due to the pressure difference, so that a contact-sensitive surface on the inner side of the film does not come into contact with a guide surface. In order to seal the inner zone from the atmosphere, sealing plates are provided that extend across the entire width of the film and can come into contact with the contact-sensitive surface. In order to prevent this happening as far as possible, air exit slits are provided in the sealing plates. The flow of air issuing from these slits, however, can likewise impair the contact-sensitive surface of the web.

In U.S. Pat. No. 3,638,845, Herzhoff et al. disclosed an apparatus in which a web is lifted by excess pressure in an inner zone sufficiently far from a cylindrical guide roll for air exit openings arranged on a circular path in both side walls to be partially unblocked by the web. A sealing strip extending across the entire width of the web is arranged between the beginning and end of the guide region. The web is respectively guided between a sealing roll that extends across the width of the web at the outer side of the web and the sealing strip. Here, too, there is a danger that the contact-sensitive surface of the web may come into contact with the sealing strip.

SUMMARY

The above and other difficulties have been alleviated with a device for guiding a web having a contact-sensitive surface through a housing. Within the housing, there is a guide member around which the web is advanced. The guide member has flanges providing guide surfaces for the edges of the web and the web divides the interior of the housing into inner and outer zones. Sealing elements extend across the housing at the beginning and end of the path of advance around the guide member. By this arrangement, the inner zone is at atmospheric pressure. A source of reduced pressure is connected to the housing in the outer zone.

With the outer zone under reduced pressure and the inner zone in communication with the ambient atmosphere, no sealing of the inner zone is needed and no sealing elements are required in the region of the contact-sensitive surface of the web. It is true that sealing elements are required to seal the outer zone from the atmosphere and that these sealing elements must extend across the entire width of the web. Since they are only situated on the outer side of the web, however, the interaction between the web and sealing elements causes no impairment of any kind of the contact-sensitive surface.

In a preferred embodiment, the guide surfaces are flanges at the ends of a rotatable, cylindrical support roll. The cylinder between the flanges forms a reinforcing surface on which the web can lie due to the web tension, in case of a malfunction, e.g., breakdown of the source of reduced pressure. The web cannot slip between the guide surfaces and immediately resumes its operating position when the pressure difference is again matched to the web tension.

It is particularly favorable if the sealing elements are rotatable sealing rolls, each of which forms a first sealing point with the web and a second sealing point with a wall of the housing. Such sealing rolls form the first sealing point without friction with the web. They can be arranged at the wall of the housing in such a way that the remaining gap only allows a little secondary air to pass through.

DRAWINGS

The invention is described below in more detail based on the preferred forms of embodiment shown in the drawings.

DESCRIPTION

Figure 1:
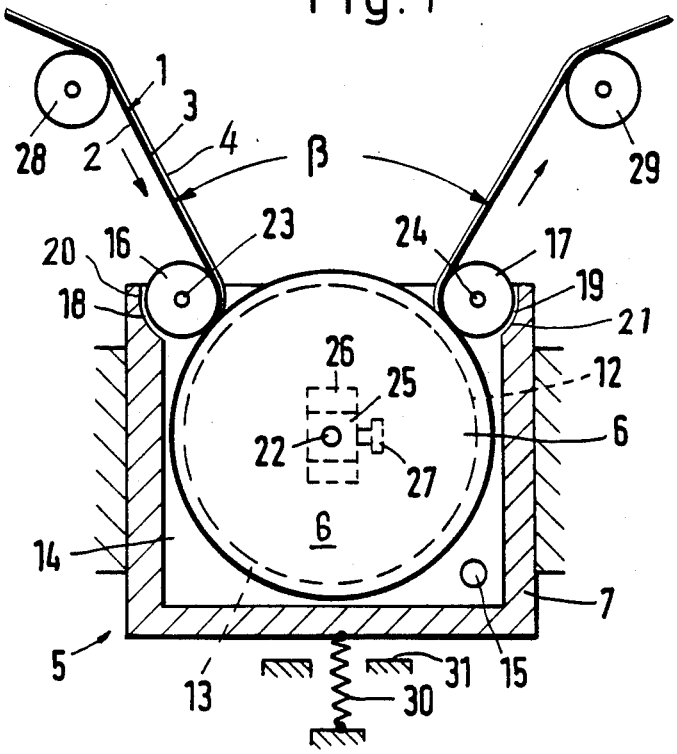
FIG. 1 shows a schematic section through a first form of embodiment of a guide device of the invention.
Figure 2:
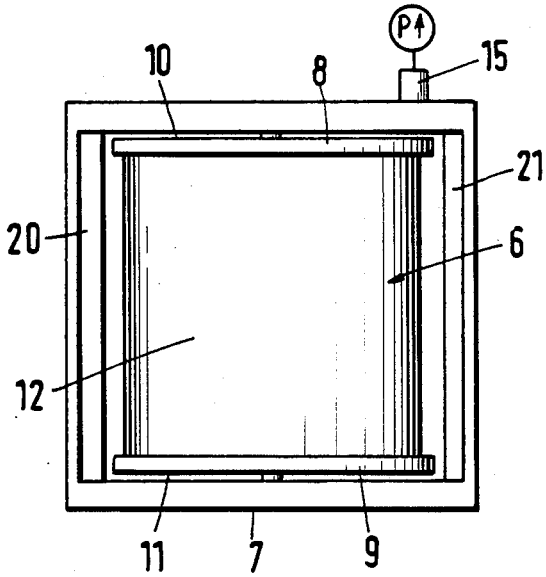
FIG. 2 shows a top view of FIG. 1 with sealing rolls omitted.
Figure 3:
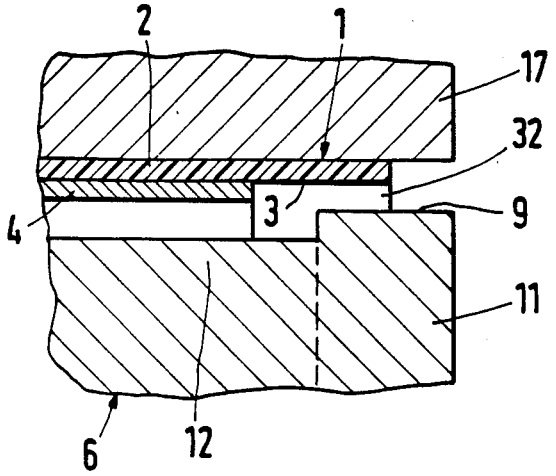
FIG. 3 is a fragmentary, sectional view of the sealing region.

In the embodiment of FIGS. 1–3, a web 1 is to be guided around an angle $\beta$. This web consists of a support 2, whose inner surface 3 is provided with a coating 4 applied shortly beforehand and is thus contact-sensitive. A typical example is a photographic film onto which one or more light-sensitive coatings are applied. Such coatings must be dried over a fairly lengthy path.

The guide device 5 has a rotatable support roll 6 in a chamber defined by an open-top housing 7. At its edges, the support roll 6 has two narrow guide surfaces 8 and 9, formed by the periphery of cylindrical flanges 10 and 11 at the ends of a cylinder 12. The web 1 separates an inner zone 13, which is formed between the cylinder 12 and the web, from an outer zone 14, which is formed between the walls of the housing 7 and the web 1. The inner zone 13 communicates with the atmosphere at the locations of two sealing rolls 16, 17. The outer zone 14 is connected to a reduced pressure source, e.g, a vacuum pump P, by a connecting branch 15.

The sealing rolls 16 and 17 are provided at the beginning and end of the guide region to seal the outer zone 14 from the atmosphere. Since the web 1 passes over the sealing rolls 16 and 17, the outer zone 14 is sealed securely by the uncoated side of the web. The sealing rolls 16 and 17 are arranged against side walls of the housing in such a way that narrow gaps 18, 19 remain. The side walls can have corresponding arcuate recesses 20, 21 for this purpose. The size of these gaps can be reduced to such an extent that the amount of air penetrating the outer zone is negligible for the operation.

The axis 22 of the support roll and axes 23 and 24 of the sealing rolls 16 and 17 are fixed in the walls of the housing 7. Displacement should be possible, however, in order to enable the optimum adjustment of the arrangement of the rolls with respect to one another and to the housing. This is illustrated for the support roll 6. A bearing block 25 for the axis 22 is displaceable in the central plane in a slit 26 of the side wall and can be stopped in any desired position with respect to the sealing rolls 16 and 17 by means of a setscrew 27. Similar displacement devices, but preferably transverse to this, are provided for sealing rolls 16 and 17.

It is indicated schematically that the web 1 is driven by a first drive roll 28 located in advance of the guide device and by a second drive roll 29 located beyond the guide device. The first drive roll ensures a prescribed web speed and the second drive roll is regulated to maintain an ideal web tension. This web tension exerts a force directed upwards (FIG. 1) on the support roll 6.

The housing 7 is loaded against the action of the web tension by a pretensioned spring 30. If the web tension falls to zero, e.g., when a coating roll is taken away, the entire housing 7 with the rolls 6, 16 and 17 mounted in it, is pressed against a stop 31. Thus, the web does not lift away from the support roll and destroy the vacuum. If that were to happen, there would be a sudden stressing of the web that would cause it to tear when web tension was readjusted.

FIG. 3 shows the sealing point in the region of the sealing roll 17. The coating 4 is narrower than the web 1 and situated completely within the width of the cylinder 12. During start-up or an operational malfunction, only the uncoated edges of the web 1 come into contact with the guide surfaces 8, 9. Rolls 16, 17 are spaced from flanges 10, 11 (FIG. 3).

Normally, however, the web 1 is lifted from the guide surfaces 8, 9 throughout the entire guide region under the influence of the pressure difference between the atmospheric pressure in the inner zone 13 and the reduced pressure in the outer zone 14, so that a throttle gap 32 is formed on both sides throughout the guide region. The size of this gap adjusts itself automatically so that the value of the reduced pressure in the outer zone 14 is matched to the web tension. If the web tension falls, the gap 32 enlarges and the pressure in the outer zone 14 rises. When the web tension increases, the gap 32 is reduced and the pressure in zone 14 drops.

If the web tension becomes zero, e.g., because a roll with which the coating 4 is applied is taken away, the gap width increases to such an extent that the vacuum in the outer zone 14 fails completely. The immediately following readjustment of the web tension leads to a strong stress on the web, which can lead to tearing. This is precluded in that the housing 7 is loaded by the spring 30. It ensures that the housing 7 withdraws if the web tension drops rapidly and thus prevents the gap 32 from opening too rapidly. Conversely, sudden increases in the web tension are likewise absorbed by the spring 30.

The total effect achieved is thus that the coating 4 is protected from any contact in the guide region. The lifting function caused by the difference in pressure between the inner and outer zones is effective in the guide region. Sealing elements are provided in the sealing region only on the uncoated outer side. If as a result of a malfunction, which can never be entirely excluded, the pressure difference were not sufficient to counteract the web tension, the cylinder 12 then serves as a reinforcement surface. The web can therefore not be pulled inwards at its edge from the guide surfaces 8, 9. Thus, when the malfunction is corrected, normal operation can resume immediately.

Figure 4:
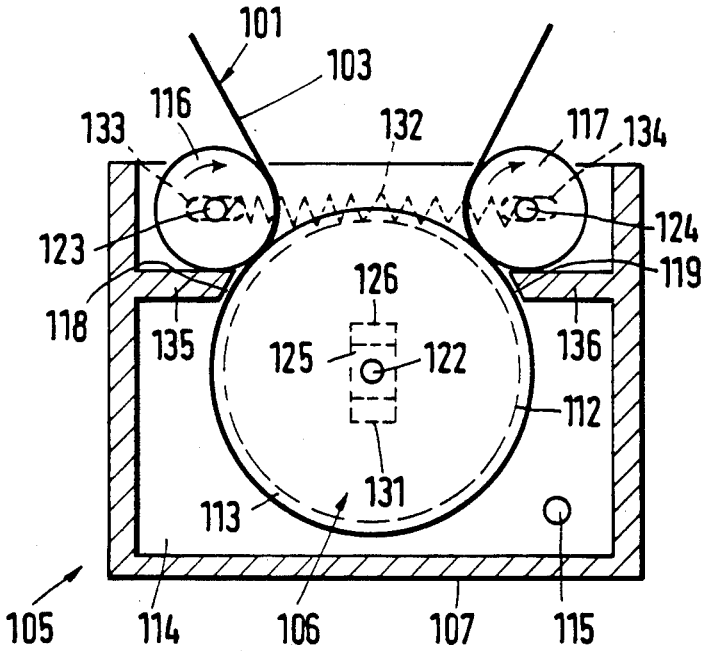
FIG. 4 shows a schematic section through a second form of embodiment.

In the embodiment shown in FIG. 4, the essential difference is that the axes 123, 124 of the two sealing rolls 116, 117 are pulled against one another by a spring 132. The axes are limited to movement toward and away from each other by slits 133 and 134. Thus, the sealing rolls lie on the support roll 106 under pretension and in their turn load it in the direction of the center plane, so that the spring 132 also takes over the function of the spring 30. The guide slit 126 has a corresponding stop 131 at its lower end. The sealing against the walls of the housing is performed by two segments 135 and 136 that extend parallel to the transverse plane through the axes 123 and 124 and their guide slits 133 and 134.

A support with guide surfaces fixed between walls of the housing can also be provided, instead of the support roll. These guide surfaces can also differ in shape from a cylindrical shape. The sealing elements can also be fixed, if the friction on the outside of the web does not cause problems.

What is claimed as new and desired to be secured by Letters Patent is:

1. Device for turning a moving web which has inside of the device an innter surface and an outer surface, said inner surface being contact sensitive, in particular freshly coated, said web separating along its length of equidirectional curvature an inner zone adjacent to said inner surface from an outer zone adjacent to said outer surface, one of said inner and outer zones being connected to the atmosphere and the air pressure in said inner zone being higher than said outer zone under operation, and in which in the region of each of the lateral edges of the inner surface of the web a guide surface is arranged, and wherein a gap forms between said inner and guide surfaces under the influence of the pressure difference between said inner and outer zones so that air flows through the gap from the inner into the outer zone, characterized in that the outer zone is formed by said outer surface of the web and a housing which is connected to a reduced pressure source, that the inner zone is connected to the atmosphere, and that sealing elements extending across the width of the web at the beginning and at the end of the equidirectional curvature of the web interact with said outer surface of the web in order to seal said outer zone against the atmosphere.

2. Device according to claim 1 characterized in that the guide surfaces are formed by cylindrical flanges of a rotatable support roll, the diameter of the roll being slightly less than the diameter of the flanges.

3. Device according to claim 2, characterized in that the sealing elements are sealing rolls, each of which forms a first sealing point with the web and a second sealing point with a wall of the housing.

4. Device according to claim 3, characterized in that the support roll and the sealing rolls are fixed at a wall of the housing.

5. Device according to claim 4, characterized in that the housing is mounted so that it can be moved as a whole approximately in the center plane of the guide region, and can be pulled against a stop by means of a pretensioned spring.

6. Device according to claim 3, characterized in that the sealing rolls are mounted so that they can be moved in the transvêrse plane defined by their axes and are resiliently tensioned against one another, that the second sealing point is situated at a wall of the housing running parallel to the transverse plane, and that the axis of the support roll is secured from moving parallel to the transverse plane.

7. Device according to claim 6, characterized in that the axis of the support roll runs approximately in the center plane of the guide region.

* * * * *